United States Patent [19]

Chow

[11] 3,985,169

[45] Oct. 12, 1976

[54] METHOD OF JOINING BODIES OF GREEN LUMBER BY FINGER JOINTS

[75] Inventor: Suezone Chow, Vancouver, Canada

[73] Assignee: Canadian Patents and Development Limited, Ottawa, Canada

[22] Filed: Feb. 11, 1976

[21] Appl. No.: 657,286

[30] Foreign Application Priority Data

Mar. 13, 1975 Canada ..... 222000

[52] U.S. Cl. ..... 144/317; 144/309 L; 144/314 B; 144/327; 156/258; 156/304; 156/322

[51] Int. Cl.[2] ..... B27D 1/10

[58] Field of Search ..... 156/563, 304, 258, 322, 156/499; 144/90 R, 90 A, 90 B, 309 R, 309 L, 314 B, 315 R, 317, 327, 2 R, 3 R, 314 R, 32 T

[56] References Cited

UNITED STATES PATENTS 3,126,308 3/1964 Brockerman et al. ..... 144/317 X 3,802,986 4/1974 Forsythe ..... 156/304 X

*Primary Examiner*—Robert Louis Spruill
*Assistant Examiner*—W. D. Bray
*Attorney, Agent, or Firm*—Francis W. Lemon

[57] ABSTRACT

Green lumber bodies are finger jointed together, using a heat curable adhesive for wood, by forming fingers on the lumber bodies, heating and drying the lumber bodies until the fingers only are dried to a moisture content of less than 50 percent (oven dry basis), cooling the fingers to which the adhesive is to be applied to prevent precure thereof, and applying the adhesive to these fingers, and then pressing the bodies together at a pressure greater that 150 p.s.i. to interlock the fingers until the adhesive is cured. Heat stored in the lumber bodies is transferred therefrom to the fingers to cure the adhesive. The adhesive may be a phenol resorcinol resin glue.

6 Claims, 10 Drawing Figures

METHOD OF JOINING BODIES OF GREEN LUMBER BY FINGER JOINTS

This invention relates to a method of joining bodies of green lumber by finger joints.

It is known from Canadian Patent No. 809,364, dated Apr. 1, 1969, Josef E. Marian, to join lumber bodies by adhesive bonding, interfitting, wedge-shaped fingers which have been formed on the lumber bodies. The wedge-shaped fingers are coated with a phenol-resorcinol resin glue, pressed together and then the glue is set or hardened at room temperature. The finger joining of lumber is particularly useful in the production of lumber in structural sizes.

At present it is not possible to successfully finger joint green lumber, and so known processes for finger jointing can only be used with dry lumber. A finger jointing process, giving adequate strength and bond quality, that could be used with green lumber would be highly desirable from an economical point of view.

It is an object of the present invention to provide a method of finger jointing, giving adequate finger strength joints, which may be used with green lumber.

According to the present invention there is provided a method of joining bodies of green lumber by finger joints, comprising:

a. forming a plurality of corresponding interfitting jointing fingers on the lumber bodies, b. heating and drying the lumber bodies at a temperature greater than 59° C until the jointing fingers only are dried to a moisture content of less than 50% oven dry basis, c. lowering the temperature of the interfitting jointing fingers to which a heat curable adhesive is to be applied for jointing, to avoid precure of the adhesive while the lumber bodies are separated, while maintaining all of the jointing fingers in the dried condition, d. coating the dried jointing fingers which are at the lower temperature, with a heat curable adhesive for wood, e. pressing the jointing fingers of the lumber bodies together in interfitting relationship with an end loading pressure greater than 150 psi on the cross-sectional area of the lumber bodies and, f. maintaining the jointing fingers pressed together for a sufficient time for heat stored in the lumber bodies, from the heating and drying, to be transferred to the fingers and set and harden the heat curable adhesive and bond the interfitting fingers to one another.

In this specification:

$$\text{oven dry basis} = \frac{\left\{\begin{matrix}\text{weight of lumber at the}\\ \text{moisture content to be}\\ \text{measured}\end{matrix}\right\} - \left\{\begin{matrix}\text{absolute oven dry}\\ \text{weight of lumber}\end{matrix}\right\}}{\text{absolute oven dry weight of lumber}}$$

Figure 1:
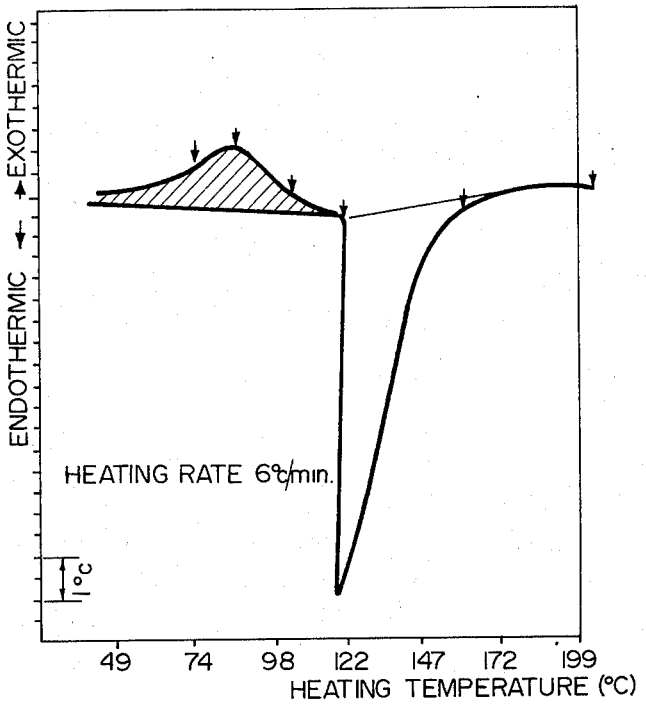
Figure 2:
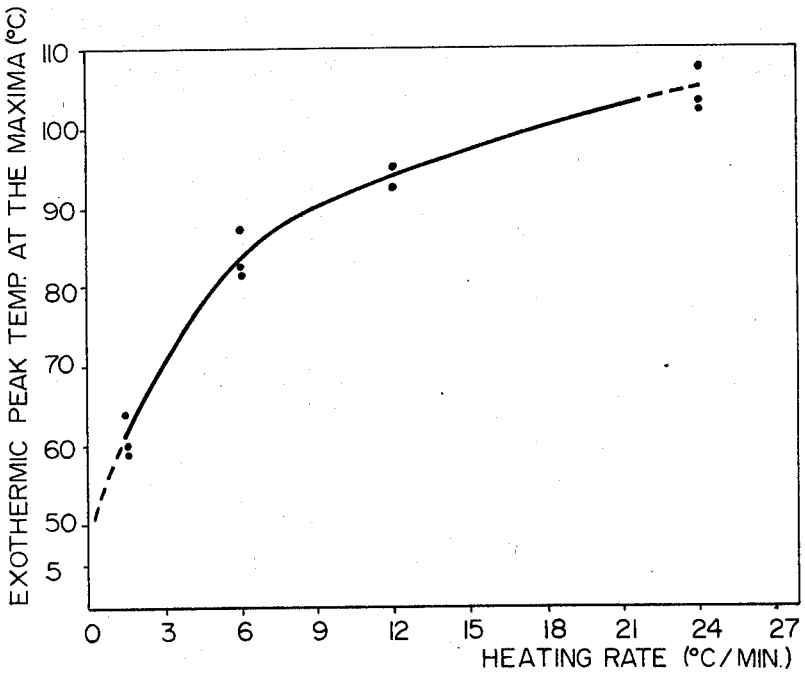
Figure 4:
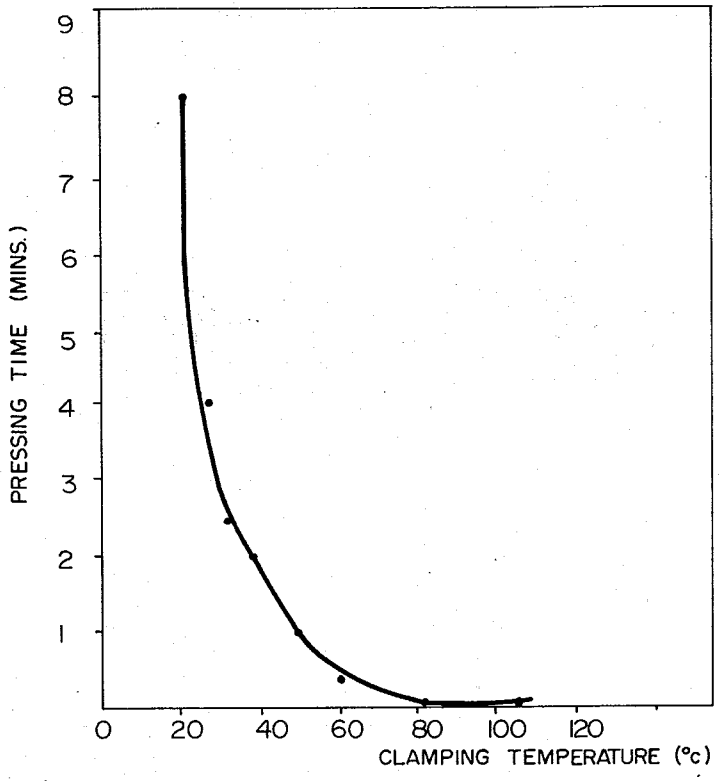
Figure 3:
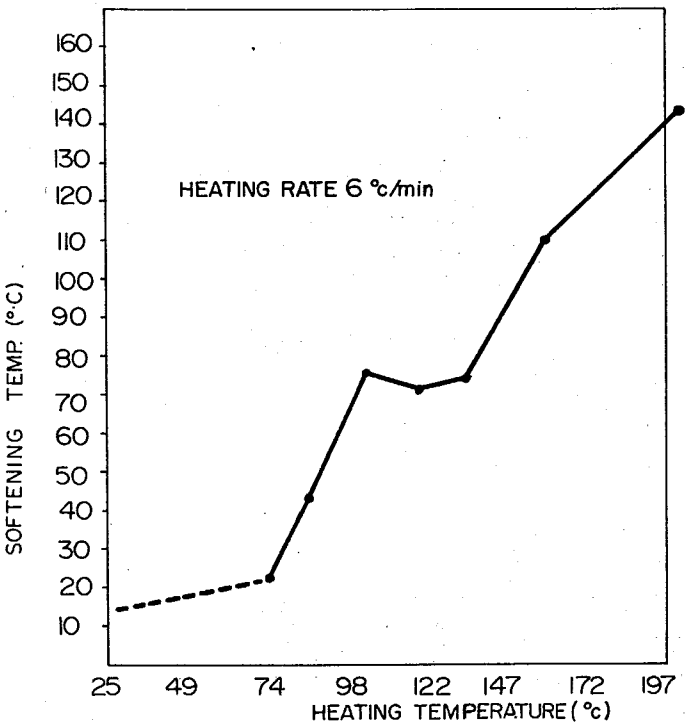
Figure 5:
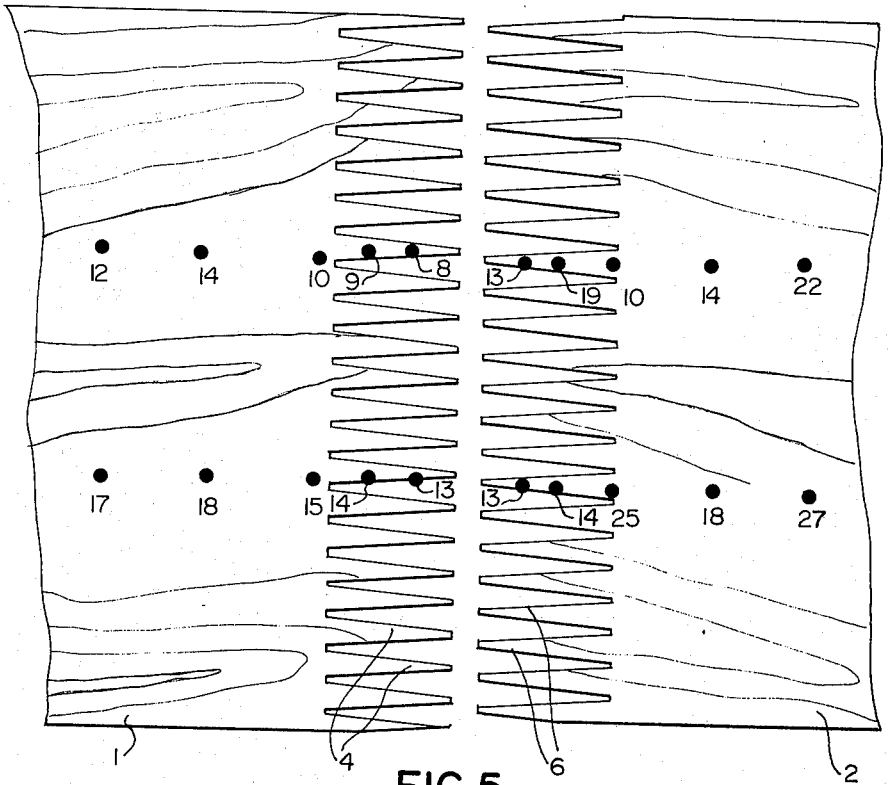
Figure 9:
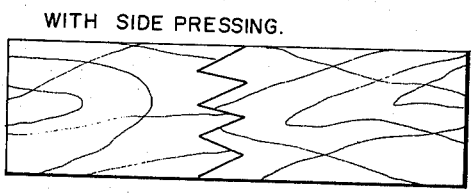
Figure 10:
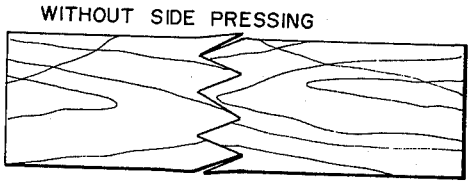
Figure 6:
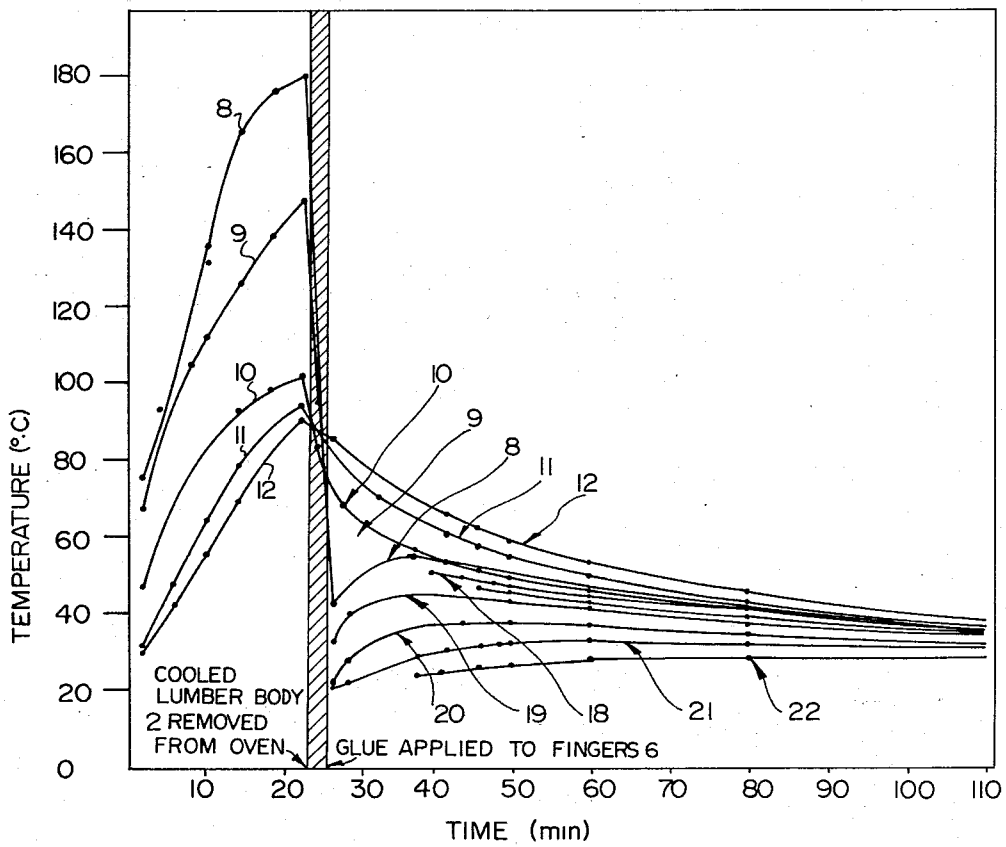
Figure 8:
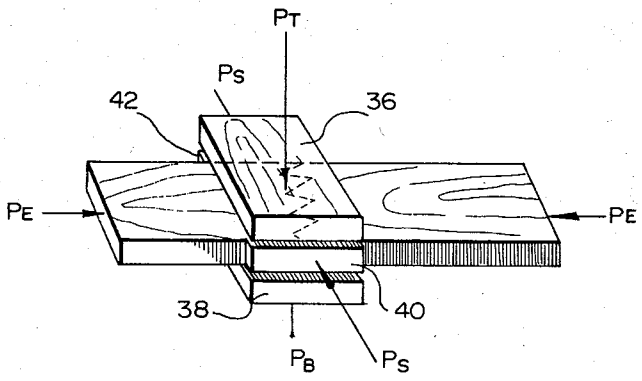
Figure 7:
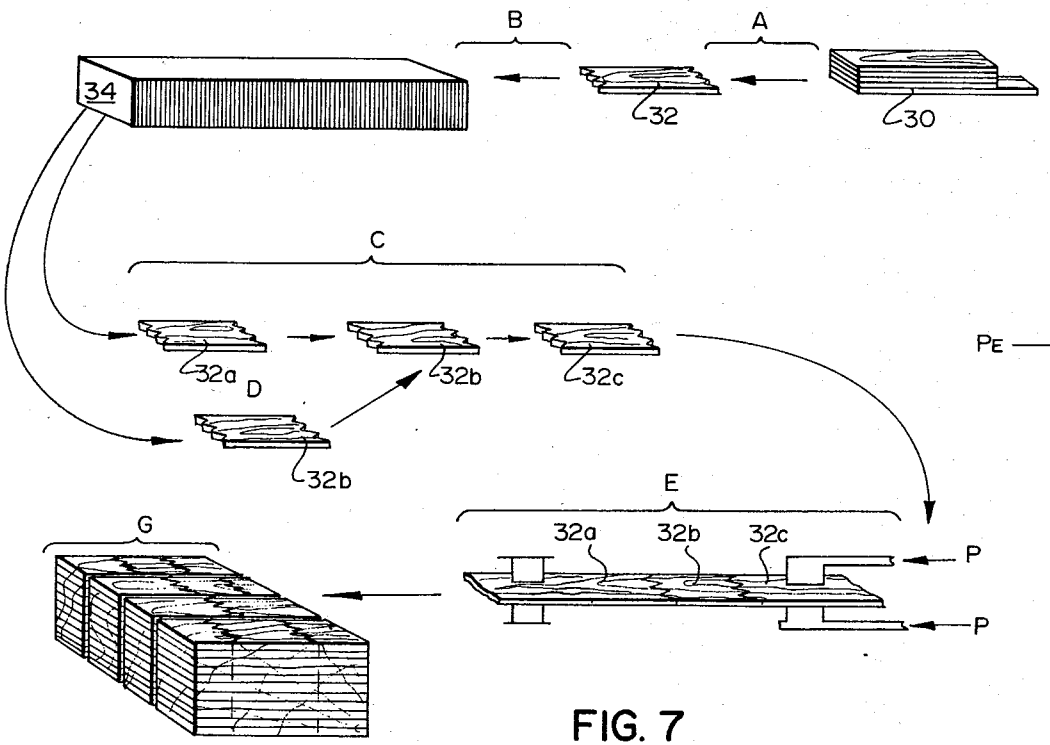

In the accompanying drawings which illustrate, by way of example, embodiments of the present invention, FIG. 1 is a thermograph of a commercially available phenol-resorcinol resin glue during setting, FIG. 2 is a graph of the heating rate plotted against the temperature during the setting of the phenolresorcinol resin glue of FIG. 1, showing the exothermic peak, FIG. 3 is a graph of the heating temperature plotted against the softening temperature during the setting of the phenol-resorcinol resin glue of FIG. 1, FIG. 4 is a graph of the clamping temperature plotted against the time for bonding a laminated beam using the same phenol-resorcinol resin glue, FIG. 5 is a plan view of two lumber blocks provided with fingers and having thermocouples inserted therein, (FIG. 5 is above FIG. 9), FIG. 6 is a graph of the temperatures recorded by the thermocouples in FIG. 5, plotted against time, FIG. 7 is a schematic diagram of a production, system for finger jointing green lumber, FIG. 8 is a perspective view of a method of pressing the fingers together, FIG. 9 is a perspective view of a finger joint wherein the fingers have been subjected to side pressure during bonding, and FIG. 10 is a perspective view of a finger joint wherein the fingers have not been subjected to side pressure during bonding.

Referring to FIG. 1, phenol-resorcinol resin glue is a weather-proof heat curable adhesive for wood and is commonly used in the wood laminating industry. This adhesive is able to set or harden at room or higher temperatures. The reason for the low temperature curing property of this adhesive is presently not known.

FIG. 1 shows a differential thermal analysis diagram of a commercially available phenol-resorcinol resin glue, during setting or hardening at a heating rate of 6° C/min., obtainable from a differential thermal analyzer. As far as the applicant is aware this is the first time that a thermogram of a phenol-resorcinol resin glue during setting or hardening has been taken and it shows the presence of an exothermic peak (under the shaded area) below 100° C. This assists in explaining why a phenol-resorcinol glue can be cured at low temperatures and to an understanding of the present invention.

FIG. 2 shows that the temperature at the maximum of the exothermic peak (in FIG. 1) is heating-rate dependant. At 6° C/min., heating rate the peak maximum shown in FIG. 1 is about 86° C, but at a lower heating rate, e.g. 1.5° C/ min, the peak maximun is about 60° C. The lower end of the exothermic band will thus extend farther into the temperature range below room temperature (25°C). On the other hand, at a faster heating rate of 24° C/min., the peak temperature will shift to about 150° C. This heating rate and exothermic temperature relationship is important in understanding the present invention.

As indicated by the arrows in FIG. 1, the phenol-resorcinol resin glue has been heated to the respective temperatures and the hardening thereof has been examined. FIG. 3 indicates that when the heating temperature reached the exothermic peak temperature (86° C; rate 6° C/min.), the resin is hardened at room temperature and can become softened only by heating to a temperature greater than 44° C.

The information from FIGS. 1, 2 and 3 explains very well the pressing schedules for laminated beam clamping, a typical example of which is shown in FIG. 4 which indicates that at 82° C, glueline temperature, about 7 mins., of pressing time is required to develop the wood-phenol resorcinol resin glue bond strength.

Two major areas of research were carried out which led to the present invention, and these were:

1. Directly jointing green lumber and them combining the phenol-resorcinol resin glue curing and the lumber drying in one process. It was found that this could be carried out and produce a product of moderate strength, when the moisture content of the lumber is below 30 to 40 percent, oven dry basis. Moisture contents of greater magnitude (i.e. in excess of 50%, oven dried basis probably cause excessive dilution and precipitation of the phenol-resorcinol resin glue at the wood surface and also due to the unrestricted shrinkage forces of wood during drying, resulting in a poor interface.

2. Modification of the phenol-resorcinol resing gluing process by utilizing the different rates of water loss (or evaporation) during drying, in the fingers and lumber bodies for minimizing the drying time and by utilizing the storage of heat in the fingers and lumber bodies for curing the phenolresorcinol resin glue.

FIG. 5 shows the shape and structure of tested lumber bodies 1 and 2 with fingers 4 and 6. The mean width of the individual fingers 4 and 6 was about 0.12 in., and the lumber bodies 1 and 2 were 5.5 in., wide. The drying of 2 in., thick × 5 in., wide green lumber in commercial practice takes at least 48 hours. The drying of a 0.1 to 0.2 in., thick wood section of green lumber takes about 10 to 30 min., in the temperature range 120° to 220° C, especially the wood fingers 4 and 6 which are composed of great numbers of exposed fibres.

With this knowledge in mind it has been found, according to the present invention, that it is possible to take advantage of the structural profiles of the fingers 4 and 6 and the lumber bodies 1 and 2 and derive a method of joining bodies of green lumber by heat drying the fingers 4 and 6 and the lumber bodies 1 and 2 until the fingers 4 and 6 only are dried to the moisture content suitable for good wood-glue bonding using a phenol-resorcinol resin glue, while the moisture content of the lumber bodies 1 and 2 can be greater than 100 percent, oven dry basis. The stored heat in the lumber bodies 1 and 2 is then later allowed to transfer to the fingers 4 and 6 for curing the phenol-resorcinol resin glue.

In order to verify the present invention, experiments were conducted to examine what drying systems and schedules are necessary to dry the fingers 4 and 6 and provide sufficient heat storage in the lumber bodies 1 and 2 to heat cure the phenol-resorcinol resin. At each of the positions designated 8 to 27, a thermocouple was inserted in the lumber bodies 1 and 2 and fingers 4 and 6, and the thermocouples were connected to a digitalized, automatic, temperature print-out instrument. The original moisture content of the lumber bodies 1 and 2 was 100 to 110 percent on an over dry basis, lumber body 2 and fingers 6 were dried in a forced-draft oven at 180° C for 30 minutes, removed from the oven, and cooled to room temperature. The lumber body 1 and fingers 4 were also dried in the same oven at 180° C and heated until the time (22 min.) that the position 8 (finger tip) temperature reached the oven temperature. The lumber body 1, with fingers 4, was then removed from the oven and exposed to air for 3 min. At this time, a phenol-resorcinol resin glue was applied to the fingers 6 of lumber body 2, and the fingers 6 were then pressed, in interfitting relationship, against the fingers 4 of lumber body 1 to form a joint.

In FIG. 6 each graph is designated by the same reference numeral as the thermocouple, in FIG. 5, whose readings it represents. The thermal history, as indicated in FIG. 6, suggests that the heat in phenol-resorcinol resin glue finger joints, and that transferred from the lumber bodies 1 and 2 is sufficient to cure the phenol-resorcinol resin glue under the exothermic conditions shown in FIGS. 1 to 4.

It should be pointed out here that the time for removing the lumber body from oven to the time of glue application, in this case, is purposely done in such a way that the example can be an extreme case for representing a very slow operation in a mill condition. This experiment demonstrated that even under such an extreme case, the glue can be cured by heat from the main lumber bodies and from any the residual heat in the fingers. In industrial application, the time from removing the lumber bodies from the heat source to the phenol-resorcinol resin application, and joining, would depend on the heating and cooling methods type of glue used and the joining system used.

FIG. 7 is a schematic lay-out of a production system, according to the present invention, based on the above experimental results. In this system, an aqueous solution of borax containing 1 percent borax by weight is applied to the fingers before the fingers are dried to prevent oven-drying of the fingers and precipitation of the glue.

In FIG. 7 green lumber bodies are continuously removed one after another from a stock 30 and have fingers cut in their ends at position A, as shown by lumber body 32, in a known manner using cutterheads (not shown). At position B the borax solution is sprayed on to the fingers. A continuous stream of lumber bodies, such as 32 is then sequentially fed on a conveyor belt (not shown) through a kiln 34 having air passed through the interior thereof at a temperature in the range e.g. 140° to 200° C and at a speed of 500 ft/min. The drying time for each lumber body, such as 32, passing through the kiln 34 is approximately thirty minutes so that the fingers only of the lumber bodies such as 32 are dried.

From the kiln 34, alternate lumber bodies, such as 32*a*and 32*c* are continuously conveyed by a conveyor belt system (not shown) directly to a station C with the fingers in the dried condition, while alternate lumber bodies, such as 32*b*, are continuously conveyed by a conveyor belt system (not shown) to a position D with the fingers in the dried condition. The transit time of the lumber bodies 32*a* and 32*c* to station C is such that by the time that these lumber bodies arrive at the station C the fingers and the main bodies can be in a temperature similar to or lower than the dryer oven temperature. similarly, the transit time of the lumber body 32*b* to the position D is such that by the time that this lumber body arrives at the position D the fingers only of the lumber body 32*b* are cooled to a temperature whereby precuring of the phenol-resorcinol resin glue is avoided upon the glue application.

The alternate lumber bodies, such 32*b*, have a phenolresorcinol resin glue applied to their dried, cooler fingers at position D, and are then continuously conveyed by a conveyer system (not shown) and are inserted between the lumber bodies 32*a* and 32*d*.

The lumber bodies 32*a*, 32*b* and 32*c* are then continuously conveyed by a conveyor system (not shown) to a position E where they are pressed end-to-end, while moving, with the fingers in interfitting relationship and with an end loading greater than 150 psi on the cross-sectional area of the lumber bodies 32*a*, 32*b* and 32*c*. The lumber bodies 32*a*, 32*b* and 32*c* are pressed together, while passing position E, for a sufficient time for heat stored in the lumber bodies 32*a*, 32*b*, and 32*c* are pressed together, while passing position E, for a sufficient time for heat stored in the lumber bodies 32*a*, 32*b* and 32*c* from the kiln drying to be transferred to the fingers and set and harden the phenol-resorcinol resin glue and bond the fingers to one another. In practice it has been found that the time necessary for the fingers to become bonded at position E depends upon the phenol-resorcinol resin glue used, however, using the phenol-resorcinol resin glue marketed by Borden Chemical Co, (Canada) Ltd., P.O. Box 610, West Hill, Ontario, Canada, as LT75 the time necessary for bonding the fingers has been found to be 60 seconds or less.

The lumber bodies 32*a*, 32*b* and 32*c*, bonded together in this manner are then continuously conveyed, by a conveyor system (not shown) to a cutting position F, where the bonded lumber bodies are cut into boards of the desired length, by known means (not shown), and then continuously conveyed by another conveyor system (not shown) and stacked at position G.

Referring now to FIG. 8, in addition to the application during bonding of an end pressure of 150 to 400 psi for the cross-sectional area of the lumber bodies, lateral pressures of 100 to 300 psi are preferably applied to all sides of the fingers during bonding. This will ensure that a joint such as that shown in FIG. 9 will be produced and will avoid any tendency that splayed joint such as that shown in FIG. 10 will be produced.

The method shown in FIG. 8 uses heated metal blocks 36, 38, 40 and 42 to apply the lateral pressures. The blocks 36, 38, 40 and 42 in this embodiment are heated electrically or by steam. Although unheated blocks may be used, the heated blocks reduce the time required to set and harden the phenolresorcinol resin.

The applied pressures to the top (PT), bottom (PB) and sides PS of the fingers are all equal and in the range 100 to 300 psi, while the end pressures PE are equal and greater than 150 psi. The pressing time can be in the range of a few seconds. If the metal blocks slightly char the wood surfaces, this may subsequently be removed by planning. The heat from the blocks 36, 38, 40 and 42 was found to provide enough thermal energy to harden and set the phenol-resorcinol resin adhesive sufficiently to maintain the joints after the pressures PT, PB, PS and PE were released.

The following experiments, which were also carried out using in some instances heated metal blocks 36, 38, 40 and 42, according to the present invention, unless otherwise specified were made using 2 in. × 4 in., spruce, pine or fir lumber bodies, with a moisture content ranging from 38 to 80 percent, with an average moisture content of 50.2 percent. All of the joints were glued with a commercial phenol-resorcinol (11.5% resorcinol content) resin glue marketed by the above mentioned Borden Chemical Ltd for ordinary lumber lamination. In these experiments where the heated metal blocks 36, 38, 40 and 42 are used they are referred to as "the heated blocks".

EXPERIMENT 1: DETERMINATION OF END PRESSURE EFFECT ON THE FINGER JOINT MAKING

The following Table 1 shows the bending strengths of finger joints made, according to the present invention, from green lumber. The lumber, with fingers cut on a commercial machine was heated in the oven at 180° C for 15 min. After a 2 min. cooling period (to prevent precure of the phenol-resorcinol resin glue) each joint was end pressed at either 200, 300, 350, 400 or 450 psi for 10 sec. and the heated blocks heated to 350° C were applied for 5 sec. Immediately after the joints were made, they were tested to failure in a universal testing machine.

Table 1.

End pressure and bending strength of green-finger joints immediately after being made.

| Pressure (psi) | Moisture[a] content (%) | Bending strength (psi)[b] Minimum | Average |
|---|---|---|---|
| 200 | 34 | 1625 | 2306 |
| 300 | 46 | 1841 | 2026 |
| 350 | 44 | 1039 | 1982 |
| 400 | 41 | 1553 | 2878 |
| 450 | 46 | 2639 | 2952 |

[a]Moisture content at the time of testing.
[b]Each moisture content and average bending strength is the result from five specimens tested in nominal 2×4 dimension.

The results indicate that an end pressure greater than 400 psi is the most appropriate for development of joints with high bending strengths.

EXPERIMENT 2: EXAMINATION OF VARYING THE END PRESSURE TIME ON THE BENDING STRENGTH OF JOINT IMMEDIATELY AFTER BEING MADE.

Green lumber was heated in an oven at 180° C for 15 min., and the joints were made without the application of the heated blocks. The time for end pressure (450 psi) was 5 to 30 sec. at 5 sec. interval.

The results, as shown in the following Table 2, indicate that the joint strength immediately after being made was greater than 490 psi with minimum of 314 psi for pressure times of 5 to 10 sec. This is sufficient to have rigidity for immediate further lumber handling. It should be pointed out that the joints were prepared by removing the lumber components from the oven for 2 minutes cooled to prevent pre-cure of the phenol-resorcinol resin glue, spread with the glue and end pressed.

The control lumber, without the oven heating or drying of the fingers prior to the joint manufacture was below 100 psi. Such control cannot be handled without damaging the joint.

Table 2.

End pressure time and bending strength relationship of green-finger joints tested immediately after being made.

(450 psi end pressure, no hot platen applied, lumber was oven-dried at 180°C for 15 min. prior to joining)

| Pressure time (sec) | Moisture[b] content (%) | Bending Strength (psi) Minimum | Average[a] | Wood Failure[a] (%) |
|---|---|---|---|---|
| 5 | 50 | 314 | 508 | 17 |
| 10 | 41 | 408 | 491 | 35 |
| 15 | 49 | 492 | 856 | 30 |
| 20 | 47 | 531 | 691 | 35 |
| 25 | 44 | 613 | 805 | 37 |
| 30 | 49 | 626 | 1272 | 33 |

[a]Each value is the test average of 5 specimens.
[b]Moisture content at test, oven dry basis.

EXPERIMENT 3: THE EFFECT OF VARYING THE APPLICATION TIME OF THE HEATED BLOCKS ON THE JOINT STRENGTH DETERMINED IMMEDIATELY AFTER THE JOINTS WERE MADE.

Green lumber was dried in an oven at 180° C for 15 min. to dry the fingers. The end pressure was 450 psi and the application time of the heated blocks was 2, 5, 10, 20, 30 and 40 sec.

The following Table 3 shows that 2 sec. of application of the heated blocks increased the joint strength 4 times over the control (oven heating only without the hot platen). At 5 sec. heating, the joints bending strength passed 2000 psi. By means of stored heat from the finger drying process and the application of the heated blocks for 5 sec. (i.e. without further curing) the joint has already passed the allowable stress for the CSA select structural grade and 3 times more than the allowable stress for studs. The effectiveness of the application of the heated blocks and oven heating combination is thus demonstrated.

Table 3.

The use of the heated blocks (350°C) application time and bending strength of green-finger joint tested immediately after being made.[a]

| Application time of the heated blocks (sec) | Moisture[b] content (%) | Bending strength (psi) Minimum | Bending strength (psi) Average[c] | Wood[c] Failure (%) |
|---|---|---|---|---|
| 0 | 41 | 408 | 491 | 35 |
| 2 | 39 | 1070 | 1736 | 33 |
| 5 | 35 | 1922 | 2165 | 41 |
| 10 | 35 | 1811 | 2322 | 42 |
| 20 | 36 | 2080 | 2364 | 46 |
| 30 | 31 | 3050 | 3329 | 43 |
| 40 | 33 | 2079 | 2468 | 49 |

[a]Before the joints were made, the lumber was dried in an oven at 180°C for 15 min. End pressure: 450 psi: end pressure time: 10 sec.
[b]Moisture content at the time of test, oven dry basis.
[c]Average of five specimen tests.

EXPERIMENT 4: DETERMINATION OF THE TEMPERATURE RANGE OF THE HEATED BLOCKS

An experiment was done with the heated blocks of 200°, 250°, 300° and 350° C, with a pressing time of 5 sec. The other experimental condition were the same as Experiment 3 and again the joints made were tested immediately after they were made.

Table 4 indicates that the temperatures of the heated blocks can be as low as 200° C, and still produce a satisfactory joint.

Table 4.

Comparison of the temperature influence of the heated blocks on the bending strength of green-finger joints tested immediately after being made[a]

| Temp. of the heated blocks (C) | Moisture[b] content (%) | Bending strength (psi) Min. | Bending strength (psi) Average[c] | Wood[c] failure (%) |
|---|---|---|---|---|
| 200 | 41 | 1974 | 2010 | 35 |
| 250 | 48 | 1953 | 2140 | 67 |
| 300 | 48 | 1740 | 2010 | 49 |
| 350 | 35 | 1922 | 2165 | 41 |

[a]End pressure: 400 psi for 10 sec. The application time of the heated blocks was 5 sec. The joints were made after the green lumber was dried in an oven at 180°C for 15 min.
[b]Moisture content at the time of test.
[c]Average of 5 specimen test.

EXPERIMENT 5: DETERMINATION OF THE DEVELOPMENT OF BOND QUALITY OF THE JOINTS MADE WITH HEATING BY THE HEATED BLOCKS

The joints were made with the heated blocks at a temperature of 300° C for 5 sec. application. The joints after manufacture were stored in a constant temperature humidity room (dry bulb 80° F and dew point 40° F) and five joints were removed for testing after 24, 48, 120 and 216 hours storage. Another five joints, which were stored for 216 hours, were submerged in water and subjected to 2 hours vacuum and 2 hours pressure (90 psi) treatment. The joints, after treatment, were tested while wet for determining the durability of the joint.

The results are shown in the following Table 5 which indicates that at 24 hour storage, the average joint strength exceeded 3000 psi, 2.3 times the allowable stress of selected grade lumber as specified by CSA Standard 0268-1974 specification for finger joints. The bond quality of the joints after storage for 120 hours (5 days), exceeded an average strength of 4000 psi and wood failure of 70 percent, the amount of wood failure required by Canadian and American specifications. The quality of bond did not deteriorate in the vacuum-pressure soak test as indicated by the high wood failure and strength retention (75 percent retention as in dimension lumber without finger joints).

Table 5.

Influence of the storage time on the bending strength of green-finger joints made with the heated blocks (300°C) application for 5 sec.[a]

| Storage time day | Storage time hour | Moisture content (%) | Bending strength (psi) Minimum | Bending strength (psi) Average | Wood failure (%) |
|---|---|---|---|---|---|
| 0 | 0 | 48 | 1740 | 2010 | 49 |
| 1 | 24 | 33 | 2856 | 3169 | 63 |
| 2 | 48 | 28 | 2610 | 3478 | 66 |
| 5 | 120 | 19 | 3987 | 4445 | 70 |
| 9 | 216 | 15 | 3154 | 4323 | 81 |
| Vacuum-pressure soak test[b] | | | | | |
| 9 | 216 | 46 | 2643 | 3188 | 86 |

[a]End pressure, 400 psi for 10 sec. The lumber was dried in an oven at 180°C for 15 min. before the joints were made.
[b]The vacuum-pressure soak test was performed by soaking joints in water under vacuum for 2 hours and then under pressure (90 psi) for 2 hours and testing while wet.

EXPERIMENT 6: DETERMINATION OF THE DEVELOPMENT OF BOND QUALITY OF THE JOINTS MADE WITHOUT USING THE HEATED BLOCKS.

The experimental conditions are the same as Experiment 5, but without using the heated metal blocks.

The following Table 6 showed that using this process, the bending strength joint immediately after being made is about 500 psi in comparison to the 2000 psi in the process with heated metal block application (Table 5). However, after 24 hours of storage the strength approached 3000 psi which is similar to the bond strength of the joints made with the heated metal application. After 120 hours storage, the bonds passed the strength and wood failure requirements of the Canadian and American standards for finger joints quality, on the basis of select structural grade lumber.

Thus the present experiment shows that both with and without the heated metal block platen application a durable joint can equally be developed. The usefulness of the heated metal block process is in giving initial additional rigidity to the joints for immediate further processing (kiln drying, planning, etc.) without fracturing the joints.

Table 6.

Influence of storage time on the bending strength of green-finger joint made without the heated blocks application.[a]

| Storage time | | Moisture[b] content | Bending strength (psi) | | Wood failure |
|---|---|---|---|---|---|
| day | hour | (%) | Minimum | Average | (%) |
| 0 | 0 | 41 | 408 | 491 | 35 |
| 1 | 24 | 29 | 2251 | 2866 | 50 |
| 2 | 48 | 19 | 3245 | 3639 | 69 |
| 5 | 120 | 16 | 3282 | 3618 | 88 |
| 7 | 168 | 14 | 3068 | 4197 | 94 |
| 9 | 216 | 13 | 3452 | 4959 | 72 |

[a]Experimental conditions are similar to Table 5.
[b]Moisture content at the time of test.

EXPERIMENT 7: STUDY OF THE BOND QUALITY OF JOINTS MADE WITH GREEN LUMBER AND THEN KILN DRIED TO 8% MOISTURE CONTENT.

Thirty joints were made with green lumber dried at 180° C for 15 min. with the heated blocks (300° C) application for 5 sec. The end pressure on the joint was 450 psi for 10 sec.

After manufacture, the joints were dried in a lumber kiln using a commercial lumber drying schedule at 60° C for 3 days.

After the kiln drying, 10 joints were tested at 8 percent moisture content. Another 10 joints were subjected to three cycles of 6 hours vacuum in water and 16 hours drying at 60° C and tested while the joints were wet (last cycle of the 6 hour vacuum soaking). The other 10 joints received 4 hours boiling in water and drying in 60° C for 16 hours and then boiled again in water for 4 hours. The joints were then cooled in water (15° C) for 1 hour before being tested.

For comparison purpose, 10 joints made without oven drying of the green lumber fingers were made with the heated blocks heat and were then kiln dried using the same commercial lumber drying schedule.

The results as shown in the following Table 7 indicate that the joint made without the pretreatment with oven-drying the fingers produced only average 434 psi and 0 percent wood failure, a total rejection of the quality.

The joint made in accordance with the present invention produced average strength of 6167 psi and 92 percent wood failure, indication of an excellent bond. The strength is 4.7 times greater than select structural grade allowable stress for dimensional lumber.

The results from boil-dry-boil and cyclic vacuum-pressure tests suggested that the finger joints made according to the present invention were of good durability.

Table 7.

Bending strengths of kiln dried green finger jointed lumber using applicant's method[a] compared with the finger jointed green lumber as controls[b]

| Moisture content (%) | Bending strength (psi) Minimum | Average[e] | Wood failure (%)[e] |
|---|---|---|---|
| Method according to the present invention[a] | | | |
| 8 | 4370 | 6167 | 92 dry test |
| 59 | 2946 | 4160 | 82 Vac.-press.test[c] |
| 27 | 3036 | 5034 | 96 Boil test[d] |
| Control[b] | | | |
| 8 | 220 | 434 | 0 Dry test |

[a]The joints made according to the present invention were done by first oven-heating of the green lumber at 180°C for 15 min. and then jointed with the application of the heated blocks (300°C) for 5 sec. The joints were then dried in kiln for 3 days at 60°C following a commercial lumber drying schedule.
[b]The CONTROL joints were made without oven drying the green lumber, but with the heat from the heated blocks. The joints were dried in kiln using the same commercial drying schedule for 3 days.
[c]The Vacuum-pressure cyclic treatment was done by subjecting the specimens to 3 cycles of vacuum soaking of joints in water for 6 hours and then dried in an oven at 60°C for 16 hours and tested while the lumber was wet.
[d]The boil test was done by boiling the joints in water for 4 hours and then dried in an oven at 60°C for 16 hours. The joints were then boiled again for another 4 hours and tested while they were cold and wet.
[e]Each value in the table was obtained from the test of 10 specimens.

EXPERIMENT 8: DETERMINING THE BENDING STRENGTH OF DRY LUMBER FINGER-JOINTS MADE WITH THE HEATED BLOCKS APPLICATION ONLY (WITHOUT PREHEATING THE FINGERS BY OVEN DRYING TREATMENT).

This is intended for comparison with the bond strength of finger joints made with green lumber as described in Experiment 7. It is also intended to demonstrate that the application of the heated blocks only will provide rigidity when joining the already kiln-dried lumber without the oven-heating for drying preheating normally used for fingers.

In the present experiment, the spruce-pine-fur lumber was kiln dried in a commercial lumber drying schedule to reach 8 percent moisture content. The lumber was then cut to finger profile and joints made at end pressure of 450 psi for 10 sec. pressing. The temperature of the heated blocks was 300° C and applied for 5 sec. after manufacture. The joints were stored in a constant temperature-humidity chamber (dry bulb 80° F and dew point 40° F) for 12 days (288 hours).

After the 12 day storage, 10 joints were tested and the other 10 joints were treated in three cycles of vacuum-pressure soak test as described in Experiment 7 and were tested wet.

The results are shown in the following Table 8. The dry strength of the finger-jointed kiln-dried lumber (Experiment 8) is about 10 percent below the Experiment 7 in which the joints were made with green lumber. The wet strength retention of the joints of Experiment 8 is about 60% of the dry strength while the wet lumber joint strength of Experiment 7 is about 70 percent of the dry strength.

The durability of finger joints made with green lumber are better than those joints made with already kiln dried lumber.

Table 8.

Bending strength of the already kiln dried spruce-pine-fir lumber (8% m.c.) jointed with hot-platen heat (300°C for 5 sec.) only without oven preheat and stored for 12 days before test.

| Moisture content (%) | Bending strength (psi)[b] Minimum | Average | Wood failure (%) |
|---|---|---|---|
| 8 | 3790 | 5660 | 87 dry test |
| 61 | 2991 | 3442 | 86 Vac.-Press[a] |

[a]The conditions for the vacuum-pressure cyclic test is the same as in Table 7.
[b]Each value is the average of the testing results of 10 specimens (not applicable to the minimum bending strength).

EXPERIMENT 9: EXPERIMENT 8 WAS REPEATED USING KILN DRIED ASPEN (8% m.c.)

The joints were made 4 months after the fingers were cut. The joining conditions are the same for Experiment 8.

The joints made were stored in the 80° F humidity room for 1, 2, 5, 7 and 9 days before testing.

The results are shown in the following Table 9. The low strength value at 9 day storage were due to the honey-comb defect in the lumber from the original high temperature kiln drying. The results indicate that the heated blocks method alone can be successfully applied to the joining of the already kiln aspen.

Table 9.

Bending strength of the already kiln dried aspen lumber (8% m.c.) jointed with the heated blocks heat (300°C for 5 sec.) without oven heat and stored for different periods of time.

| Storage time day | hour | Bending strength (psi)[a] Minimum | Average | Wood Failure (%) |
|---|---|---|---|---|
| 0 | 0 | 1360 | 1953 | 40 |
| 1 | 24 | 3320 | 4702 | 66 |
| 2 | 48 | 4813 | 6032 | 64 |
| 5 | 120 | 4494 | 5453 | 95 |
| 7 | 168 | 5792 | 6500 | 81 |
| 9 | 216 | 2323[b] | 5126 | 81 |

[a]Each value is the average of the testing results of 5 specimens (other than the minimum bending strength).
[b]The low value was caused by the excessive honeycomb of the lumber due to a kiln drying defect.

EXPERIMENT 10: GREEN SPRUCE-PINE-FIR OF 2×6 IN DIMENSION AND MOISTURE-CONTENT FROM 27 to 120 PERCENT WERE JOINTED IN THE SAME CONDITION AS EXPERIMENT 6

The joints were stored in the 80° F humidity room for 6 days after manufacture.

The results are shown in the following Table 10. The good bond quality as shown in the high strength 5341 psi (21 percent moisture content when tested) and the 85 percent wood failure suggests that the method according to the present invention can be applied to lumber with moisture contents greater than 100 percent.

Table 10.

Bending strength of the green-finger joints made with 2×6 in. dimension lumbers with original moisture content ranged 27–120%.

The lumber was oven-dried at 180°C for 15 min. before joining. The joints were made with the heated blocks heat (300°C for 10 sec.) and end pressure of 450 psi for 10 sec. The joints were stored for 6 days before test.

| Moisture content (%) | Bending strength (psi)[a] Minimum | Average | Wood Failure (%) |
|---|---|---|---|
| 21 | 3530 | 5341 | 85 |

[a]The value is the average of 5 specimen test.

EXPERIMENT 11: COMPARISON OF THE BOND QUALITY OF FINGER-JOINTS WITH AND WITHOUT THE BORAX TREATMENT OF FINGER SURFACES BEFORE OVEN DRYING.

One percent borax solution was sprayed on wood finger surfaces prior to the drying in oven at 180° C for 15 min. The joints for both borax treated and without borax treated lumbers were then jointed without using the heated blocks. The end pressure was 450 psi for 10 sec. and the joints were tested after 1 day's storage.

The results are shown in the following Table 11. The superior bond quality of the borax treated joints could be due to the fact that the borax served both to prevent overdrying of the wood surface and to accelerate the phenol-resorcinol glue cure by adjusting the pH of the wood surface.

Other heat curable adhesives for wood that may be used to bond interfitting fingers of lumber bodies, according to the present invention are, for example, urea-formaldehyde, urea-melamine formaldehyde and catalyzed polyvinyl actate type resins which harden on the thermal polymerization principle and the type of resins such as non-catalyzed polyvinyl acetate and casein glues in which the curing of adhesive, although is not depending on thermal polymerization, can be accelerated by heat application.

Table 11.

Comparison of the bending strength of borax treatment on fingers before oven-drying and the strength of joints made without the borax treatment.

| Without borax treatment | Moisture content[b] (%) | Bending Strength (psi) Minimum | Average | Wood failure (%) |
|---|---|---|---|---|
| Without borax treatment | 29 | 2251 | 2866[a] | 50 |
| With borax treatment | 28 | 3258 | 3448 | 90 |

[a]The average bending strength and wood failure is obtained by testing 5 specimens. The lumber before joining was oven-dried for 15 min. at 180°C and joined without hot platen heat. End pressure was 450 psi for 10 sec. Strengths were measured after one day's storage at room temperature.
[b]Moisture content at time of test.

Further experiments have been carried out for joining bodies of green lumber by finger joints using a drying temperature of 60° C and with the drying times of 0, 30, 60, 90 and 120 mins. The lumber used was western hemlock (2 inches × 4 inches) with an average moisture content of 89 percent (oven dry basis). Except for the control which was designated as 0 min. heating time, all other pieces were spread with 2 percent borax solution before drying. The end pressure (PE) was 600 psi for 15, 30 and 60 seconds. Hot platen heating was not used in these tests. The results are shown in the following table.

EXAMINATION OF THE 60°C DRYING TEMPERATURE ON THE BENDING STRENGTH OF WESTERN HEMLOCK FINGER JOINTS

| Heating time (min.) | End pressure (PE) time (second) | Storage time (hour) | Moisture content* (%) | | | Bending strength* (psi) | |
|---|---|---|---|---|---|---|---|
| | | | A | B | C | Minimum | Average |
| 0 | 60 | 168 | 116 | 116 | 47 | 652 | 835 |
| 30 | 15 | 24 | 101 | 92 | 71 | 568 | 815 |
| | 30 | 24 | 97 | 84 | 70 | 1093 | 1247 |
| | 60 | 24 | 102 | 89 | 82 | 1308 | 1470 |
| 60 | 15 | 24 | 79 | 65 | 52 | 1821 | 2350 |
| | 30 | 24 | 83 | 67 | 45 | 2288 | 2887 |
| | 60 | 24 | 89 | 69 | 48 | 1910 | 2409 |
| 90 | 15 | 24 | 127 | 101 | 91 | 1395 | 1734 |
| | 30 | 24 | 107 | 78 | 66 | 1962 | 2728 |
| | 60 | 24 | 79 | 59 | 50 | 1749 | 2254 |
| 120 | 15 | 24 | 92 | 61 | 49 | 2165 | 3120 |
| | 30 | 24 | 92 | 63 | 52 | 2930 | 3109 |
| | 60 | 24 | 92 | 65 | 51 | 2382 | 3083 |

A: Green lumber moisture content.
B: Moisture content during joining.
C: Moisture content at the time of strength testing.
*: Each value is derived with the average of the test of 3 specimens and is given on the oven dry basis.

The data indicate that the finger joint can develop sufficient strength even with 24 hours (1 day) storage time at room temperature after the finger joints are made. The control joint strength, stored for 168 hours (7 days) developed only 20 to 50 percent the strength of the finger joint made in accordance with the present invention. The success in the finger jointing of green lumber bodies in the 60° C range shows that the method according to the present invention can be used in finger jointing whole logs for lumber processing or veneer peeling.

The 60° C range for finger drying is also adequate for adhesive curing. As shown in FIG. 1, the phenol-resorcinol glue shows an exothermic reaction with the peak temperature at about 85° C at a heating rate of 60° C/min. FIG. 2 shows that the peak temperature shifts to about 59° C when the applied heating rate is about 2° C/min. This fundamental data indicates that the adhesive can be cured in the 59° C heating condition and develop sufficient strength to satisfy normal wood-use strength requirements.

I claim:

1. A method of joining bodies of green lumber by finger joints, comprising:

a. forming a plurality of correspondingly interfitting jointing fingers on the lumber bodies, b. heating and drying the lumber bodies at a temperature greater than 59° C until the jointing fingers only are dried to a moisture content of less than 50 percent oven dry basis.

c. lowering the temperature of the interfitting jointing fingers to which a heat-curable adhesive is to be applied for jointing, to avoid precure of the adhesive while the lumber bodies are separated, while maintaining all of the jointing fingers in the dried condition, d. coating the dried jointing fingers which are at the lower temperature, with a heat-curable adhesive for wood, e. pressing the jointing fingers of the lumber bodies together in interfitting relationship with an end loading pressure greater than 150 psi on the cross-sectional area of the lumber bodies and, f. maintaining the jointing fingers pressed together for a sufficient time for heat stored in the lumber bodies, from the heating and drying, to be transferred to the fingers and set and harden the heat-curable adhesive and bond the interfitting fingers to one another.

2. A method according to claim 1, where an aqueous solution of borax, is sprayed on to the fingers before the lumber is heated and dried at the temperature in the range greater than 59° C.

3. A method according to claim 1, wherein, during the said maintaining the fingers pressed together, side pressures in the range of 100 to 200 lbs/square inch are applied to all sides of the lumber bodies over an area including the fingers.

4. A method according to claim 3, wherein, the side pressures are applied by blocks heated to temperature in the range greater than 100° C.

5. A method according to claim 1, wherein the heat curable resin is a phenol-resorcinol resin glue.

6. A method according to claim 1, wherein, the finger jointed, green lumber is stored for at least 24 hours before being used.

* * * * *